US008183756B2

(12) United States Patent
Terletska et al.

(10) Patent No.: US 8,183,756 B2
(45) Date of Patent: May 22, 2012

(54) THERMIONIC ELECTRON EMITTER, METHOD FOR PREPARING SAME AND X-RAY SOURCE INCLUDING SAME

(75) Inventors: Zoryana Terletska, Hamburg (DE); Stefan Hauttmann, Buchholz (DE)

(73) Assignee: Koninklijke Philips Electronics NV, Eindhoven (NL)

( * ) Notice: Subject to any disclaimer, the term of this patent is extended or adjusted under 35 U.S.C. 154(b) by 308 days.

(21) Appl. No.: 12/670,133

(22) PCT Filed: Jul. 18, 2008

(86) PCT No.: PCT/IB2008/052899

§ 371 (c)(1), (2), (4) Date: Jan. 22, 2010

(87) PCT Pub. No.: WO2009/013685

PCT Pub. Date: Jan. 29, 2009

(65) Prior Publication Data

US 2010/0207508 A1 Aug. 19, 2010

(30) Foreign Application Priority Data

Jul. 24, 2007 (EP) ..... 07113058

(51) Int. Cl.

| | |
|---|---|
| ***H01J 1/15*** | (2006.01) |
| ***H01J 19/08*** | (2006.01) |
| ***H01K 1/02*** | (2006.01) |

(52) U.S. Cl. ..... 313/341; 313/310; 313/311; 445/51; 445/50; 378/136

(58) Field of Classification Search ..... 313/341, 313/310, 311; 378/136; 445/51, 50
See application file for complete search history.

(56) References Cited

U.S. PATENT DOCUMENTS

| | | | | |
|---|---|---|---|---|
| 3,290,543 | A * | 12/1966 | Weissman | 313/346 R |
| 4,524,297 | A * | 6/1985 | Gartner | 313/346 R |
| 6,259,193 | B1 * | 7/2001 | Lipkin et al. | 313/341 |
| 6,419,758 | B1 | 7/2002 | Bewlay et al. | |
| 6,464,551 | B1 * | 10/2002 | Lipkin et al. | 445/50 |
| 2002/0024280 | A1 | 2/2002 | Miyamoto et al. | |
| 2002/0167258 | A1 | 11/2002 | Dittrich et al. | |

FOREIGN PATENT DOCUMENTS

| | | |
|---|---|---|
| DE | 1439890 | 4/1969 |
| DE | 4305558 A1 | 8/1994 |
| EP | 0081270 A2 | 6/1983 |
| EP | 0235619 A1 | 9/1987 |

* cited by examiner

*Primary Examiner* — Mariceli Santiago
*Assistant Examiner* — Glenn Zimmerman

(57) ABSTRACT

A thermionic electron emitter (1) is proposed comprising an emitter part (2) with a substantially flat electron emission surface (3) and a bordering surface (5) adjacent thereto. In order to better absorb main stress loads (L) induced by external forces, the emitter part is provided with an anisotropic polycrystalline material having a crystal grain structure of elongated interlocked grains the longitudinal direction (G) of which is oriented substantially perpendicular to the direction (L) of the main stress loads occurring under normal operating conditions.

9 Claims, 3 Drawing Sheets

THERMIONIC ELECTRON EMITTER, METHOD FOR PREPARING SAME AND X-RAY SOURCE INCLUDING SAME

FIELD OF THE INVENTION

The present invention relates to a thermionic electron emitter for emitting electrons by thermionic emission, to a method for preparing such thermionic electron emitter and to an X-ray source including such thermionic electron emitter.

TECHNICAL BACKGROUND

Future demands for high-end CT (computer tomography) and CV (cardio vascular) imaging regarding the X-ray source may be higher power/tube current, shorter response-times regarding the tube current, especially when pulse modulation is desired, and smaller focus spots corresponding to the demands of future detector systems.

One key to reach higher power in smaller focus spots may be given by using a sophisticated electron-optical concept. But of the same importance may be the electron source itself and the starting conditions of the electrons. For a thermionic electron emitter for X-ray tubes it may be essential to heat up a metal surface to get electron emission currents of up to 1-2 A. These electron currents within the tube may be necessary for state-of-the-art medical applications. For today's high-end X-ray tubes, directly or indirectly heated thin flat emitters are usually used.

FIG. 1*a* shows an example of a conventional directly heated thin flat emitter 101 having a rectangular outline. The flat electron emission surface 103 is structured with narrow slits 109 to define an electrical path and to obtain the required high electrical resistance. The thin emitter film is fixed at connection points 105 to terminals 107 through which an external voltage can be applied to the structured emission surface in order to induce a heating current for heating the emission surface to temperatures for thermionic electron emission, e.g. more than 2000° C.

This emitter concept may have small thermal response times due to its small thickness of 100 to 200 μm and sufficient optical qualities owing to its flatness. Variations of this design concept are implemented in today's state-of-the-art X-ray tubes.

FIG. 1*b* shows another example of a conventional directly heated thin flat emitter 201 having a circular outline. The flat electron emission surface 203 is structured with circularly curved narrow slits 209 to define an electrical path. Through connection points 205 and terminals 207 connected thereto, an external voltage can be applied to the emission surface for inducing a heating current.

FIG. 2 shows a schematic top view on an emitter 1 as shown in FIG. 1*a*. Slits 9 (the width of which is shown exaggerated in FIG. 2) are formed in the emission surface 3 such that a meander-like structure with a conduction path 11 results.

In order to achieve the level of electron emission necessary for example for application of the electron emitter in an X-ray tube, the above emitters described with respect to FIGS. 1*a*, 1*b* and 2 having a meander-like structured emission surface may be heated up to 2400° C. in their emission surface 3 by application of an electric current. Bordering surfaces 5 adjacent to the actual electron emission surface are also heated but the temperatures reached there are to low for thermionic electron emission. At elevated temperatures, the mechanical stability and rigidity of the emitter structure can be reduced significantly.

Due to its inertia, the electron emitter may experience accelerations of more than 30 g, e.g. caused by rotation of the emitter on a CT gantry. As a result of the application of such external load, the meander-like structure may deform in such a way that the width of the slits 9, 109, 209 in partial areas of the emitter increases and, more crucial, decreases in other partial areas.

Regardless of the direction of the applied external load, the highest maximum of mechanical stress is usually achieved in an area 13 of high curvature of the meander-like emitter structure as schematically shown in the enlarged partial view of FIG. 3*b*. In the figures, the external force F may be applied in any direction parallel to the surface of the electron emitter whereas the main mechanical stress loads L in the area 13 is usually directed along the X-axis as depicted in the figures.

The combination of the high temperature and the mechanical stress may lead to creep deformation of the emitter structure especially in the mainly loaded areas 13. Creep deformation in X-direction in such area can cause a pre-mature contact of the bars 12 forming the conduction path 11 of the meander-like emitter structure and, subsequently, may lead to a short circuit. This may deteriorate the electron emission characteristics of the emitter and, furthermore, may reduce the lifetime of the electron emitter.

There may be a need for an improved thermionic electron emitter and an X-ray source including same as well as for a method for preparing a thermionic electron emitter, wherein the electron emission characteristics are improved and/or the stability of such electron emitter characteristics over time is increased and/or the lifetime of the electron emitter is increased.

SUMMARY OF THE INVENTION

This need may be met by the subject-matter according to one of the independent claims. Advantageous embodiments of the present invention are described in the dependent claims.

According to a first aspect of the invention, a thermionic electron emitter is proposed comprising an emitter part comprising a substantially flat electron emission surface and a bordering surface adjacent to the electron emission surface. The thermionic electron emitter further comprises a heating arrangement for heating the emission surface to a temperature for thermionic electron emission. The emitter part comprises an anisotropic polycrystalline material with a crystal structure of elongated interlocked grains having a dimension in a longitudinal direction larger than in a transversal direction. The longitudinal direction of the grains is oriented perpendicularly to a direction in which main stress loads occur during normal operation of the emitter.

The first aspect of the present invention may be seen as based on the idea to provide a thermionic electron emitter in which, by using an anisotropic polycrystalline material, an increased mechanical stability in a direction, in which the main loads usually occur, can be achieved. This increased mechanical stability can be achieved by orienting the longitudinal axis of elongated interlocked grains of the polycrystalline material in a direction substantially perpendicular to the direction of main stress loads.

In the following, possible features and advantages of the thermionic electron emitter according to the first aspect will be explained in detail.

Herein, a thermionic electron emitter may be interpreted as having an electron emission surface which, during operation, is heated by a heating arrangement to a very high temperature of for example more than 2000° C. for thermionic electron emission such that electrons in the emission surface have such high kinetic energy as to emanate from the emission surface. The released electrons can then be accelerated within an electrical field and can be directed e.g. onto an anode in order to generate X-rays.

The emission surface is substantially flat which means that there are substantially no curvature or protrusions within the emission surface which might disturb or deviate the electrical potential applied between the electron emitter and an anode. However, the emission surface may be structured for example by way of slits or gaps such as to define conduction paths of predetermined electrical resistance. By applying an external voltage to end terminals on these conduction paths, a current may be induced within the conduction paths for heating the emission surface.

In its emitter part, the thermionic electron emitter further comprises at least one bordering surface adjacent to the actual electron emission surface. During operation, this bordering surface is usually less or not actively heated and remains at a temperature substantially below the temperature for thermionic electron emission. For example, the bordering surface can have a temperature of less than 2000° C. due to heat exchange with the electron emitter surface being itself at more than 2000° C. The bordering surface can e.g. be used for fixing the emitter part to a cathode cup or for attaching terminals to the emitter part through which an external voltage can be applied to the emitter part for inducing the heating current.

The heating arrangement for heating the emission surface may be realized in different manners. In so-called directly heated thermionic electron emitters, the heating arrangement may be integrated into the emitter part of the electron emitter. As mentioned before, terminals may be provided on the emitter part and the electron emission surface and optionally also parts of the bordering surface may be structured to have electrical conduction paths such that electrical current flowing through these paths heats the emission surface. The actual temperature of the emission surface and the electron emission properties then depend inter alia from the applied external voltage, the material characteristics of the electron emission surface and the geometry of the electron emission surface.

Alternatively, in so-called indirectly heated electron emitters, an external heating arrangement can be provided. For example, accelerated electrons from an auxiliary electron source may be directed onto the emission surface of the electron emitter in order to heat it by electron bombardment. Alternatively, a source of intense light such as a laser may be directed onto the emission surface for heating same by light absorption.

The material used in the emitter part, particularly for the electron emission surface and, optionally, also for the bordering surface, may be any anisotropic polycrystalline material suitable for high temperatures for thermionic electron emission. Therein, the macroscopically anisotropic properties of the polycrystalline material result from a crystal structure in which the majority of elongated crystal grains are substantially oriented in a common longitudinal direction. Due to this anisotropic structure, the mechanical properties of the polycrystalline material may be different in different directions. For example, creeping of the material at high temperatures may be substantially different when an external force is applied to the material in the longitudinal direction compared to when the force is applied substantially perpendicularly thereto.

It has been found by the inventors of the present invention that an advantageous electron emitter can be provided when the longitudinal direction defined by the anisotropic polycrystalline material is oriented substantially perpendicular to a direction, in which main stress loads usually occur during operation of the emitter. A person skilled in the art who designs an emitter part for a thermionic electron emitter optionally including slits or gaps for example within the flat electron emission surface usually knows in which direction the main stress loads occur during normal operation of the emitter. Such direction and magnitude of stress loads may depend inter alia from the outline of the emitter part, the inner structure of the emitter part including optional gaps or slits, the position of mechanical support of the emitter part to a carrying structure for example within an X-ray tube and the movements and accelerations the emitter part is subjected to under normal operation conditions. Taking into account such parameters and conditions, one skilled in the art can estimate, simulate or measure the direction and possible magnitude of main stress loads occurring during normal operation of the emitter. The direction of such main stress loads can be the same over the entire surface of the emitter part or it can vary over this surface due to local geometries or properties of the emitter part. For example, as will be described below in detail, the main stress loads in a flat, rectangular emitter part such as that shown in FIG. 1*a* is usually parallel to the longitudinal axis of the emitter part whereas in a circular emitter part such as shown in FIG. 1*b*, the direction of stress loads may significantly depend on the position on the surface of the emitter part.

In case of a directly heated electron emitter, the anisotropic polycrystalline material can be an electrically conductive material such as a metal. Examples for such materials are tungsten, tungsten alloy (WRe) or tantalum.

In this context, the term "substantially perpendicular" orientation shall be interpreted taking into account the aim of using the anisotropic crystal structure. The proportion of elongated crystal grains having grain boundaries in an orientation between 45° and 135° with respect to the direction of main stress loads should prevail. In other words, more grain boundaries are oriented substantially perpendicular to the direction of main stress loads than substantially parallel to this direction. This is in contrast to conventional electron emitters using isotropic polycrystalline material in which statistically all directions of grain boundaries occur in the same proportion.

According to an embodiment of the present invention, in the thermionic electron emitter, the longitudinal direction of the grains is oriented substantially perpendicular to the direction of main stress loads in both regions, the electron emission surface as well as the bordering surface.

This embodiment is based on the finding, that, during operation, both regions are at elevated temperatures of between several hundred degrees Celsius and up to 2500° C. On the one hand, at such elevated temperatures, the mechanical stability of the emitter part may significantly suffer such that orienting the elongated crystal grains as described above may advantageously contribute to the stability of the heated emitter part. On the other hand, it has been found that crystal grains can "slip" along their grain boundaries especially at such elevated temperatures which can lead to a plastic deformation of the polycrystalline material. The process of "slipping" crystal grains is also known as "creeping" of the material. Such mechanical creeping can already appear at temperatures as they occur in the bordering surface.

Furthermore, it has been found that crystal growth and re-orientation of the crystal structure can appear at elevated temperatures and external forces. Therein, the velocity of crystal growth strongly depends on the temperature and the direction of re-orientation is influenced by a transient temperature gradient and the direction of local maximum stress. In the heated emission surface, the temperature is very high but the temperature gradient is relatively small such that there may be only minor re-orientation of the crystal structure in this region. In contrast hereto, in the bordering region, large temperature gradients may occur trying to re-orient the crystal structure in a direction parallel to the direction of main stress loads. As such parallel crystal structure would be disadvantageous with respect to the mechanical stability of the entire emitter part, such parallel re-orientation should be delayed as much as possible. Therefore, it can be advantageous to provide the emitter part with a grain orientation substantially perpendicular to the direction of main stress loads over its substantially entire surface in order to have advantageous "start conditions" for thermionic electron emitter.

According to a further embodiment of the present invention, slits are provided in the electron emission surface in order to define conduction paths in a meander form wherein the meander form comprises local regions of high curvature with local regions of lower curvature adjacent thereto and wherein the longitudinal direction of the grains is perpendicular to a longitudinal direction of the meander form in the local regions of higher curvature. In other words, the electron emission surface can include conduction paths where parts of the conduction paths are electrically separated by gaps or slits. Therein, the conduction paths get a meander form wherein the conduction paths has parts where it is straight or hardly curved and other parts where it is strongly curved. It has been found that the main mechanical stress to the conduction paths occurs in the region of high curvature and that the direction of such stress loads is usually parallel to the longitudinal direction of the meander form of the conduction paths. Accordingly, it may be advantageous to orient the elongated crystal grains perpendicular to this longitudinal direction of the meander form in the local region of higher curvature in order to better absorb such local stress loads.

According to a further embodiment of the present invention, the emitter part has a rectangular outline and includes linear slits in order to define conduction paths in a meander form. Therein, the crystal grains are oriented substantially parallel to the longitudinal direction of the slits. For example, the slits can be formed parallel to shorter side edges of the rectangular outline. The slits may be fabricated for example by lasering or wire erosion and may have a width of a few hundred micrometers.

Alternatively, in an emitter part having e.g. a circular geometry, stress loads may vary in strength and direction at different locations within the surface of the emitter part. Accordingly, the direction of the crystal grains may have to be adapted to the local stress loads. This can be realised e.g. by locally re-orienting the crystal structure by applying high temperatures with suitably locally oriented transient temperature gradients.

According to a further embodiment of the present invention the emitter part is provided with a crystallized metal sheet having a uniform crystal grain structure of elongated interlocked grains. In other words, the general crystal grain structure is the same over the entire surface of the emitter part. Such anisotropic crystallized metal sheets can be prepared for example by milling or rolling a metal sheet thereby defining a privileged direction in the direction of rolling or milling. In a subsequent annealing step at elevated temperatures of more than 1600° C., the crystal grains of the metal sheet grow preferably along the privileged direction. Therein, the extent of crystal grain growth may depend on a selected process temperature and time wherein the longer the time and the higher the temperature the larger the size of the elongated crystal grains.

It has been found that the dimensions and size of the crystal grains seem to saturate at a certain value. In other words, when growing or recrystallizing the crystal grains of the anisotropic crystalline material, the crystal grains grow up to a certain size of saturation of crystal growth and then do not continue to substantially grow independent of whether they remain at an elevated temperature for a further time period. According to a further embodiment, it is preferred that the dimension of the crystal grains is such as after such substantial saturation of crystal growth. It has been found that crystal grains of such maximum achievable size are especially stable and do not tend to re-orient or re-crystallize substantially at elevated temperatures as they occur during normal operation of the thermionic electron emitter. Typical dimensions of the grains after substantial saturation of crystal growth are a length of up to 100 μm and a width of up to 500 μm.

According to a further aspect of the present invention, a method of preparing an electron emitter for thermionic electron emission is proposed, the method comprising: determining a design of the electron emitter; determining a direction of main stress loads occurring during normal operation of the electron emitter; preparing the electron emitter with an anisotropic polycrystalline material with a crystal structure of elongated interlocked grains having a dimension in a longitudinal direction larger than in a transversal direction. Herein, the longitudinal direction of the grains is oriented substantially perpendicular to the direction of main stress loads.

The step of determining the design of the electron emitter may comprise determining an outline of the emitter such as a rectangular or circular outline, determining the geometry and size of potential slits within the electron emission surface, etc. Knowing the design of the electron emitter and the conditions of the actual application in which the electron emitter is intended to be operated such as for example in a rotating CT gantry, the main stress loads to be expected under such normal operation conditions can be determined for example by experimentation, simulation or experience. Knowing these main stress loads, an advantageous orientation of crystal grains can be determined in order to reduce creeping of the polycrystalline material used for the electron emitter.

According to a specific embodiment of the method a sheet of anisotropic polycrystalline material is provided with a crystal structure of elongated interlocked grains, the sheet having a rectangular outline. Into this sheet linear slits are prepared such that the orientation of the slits is substantially parallel to the longitudinal direction of the grains. As outlined further above, sheets of polycrystalline material such as polycrystalline metal can be easily prepared with a homogeneous orientation of the grains over their entire surface. By forming simple linear slits into such sheet material for example by lasering or wire erosion a rectangular thermionic electron emitter can be easily formed realizing the advantageous orientation of the crystal grains as described above.

According to a third aspect of the present invention, an X-ray source including a thermionic electron emitter as described above is proposed. Due to the advantageous properties of the thermionic electron emitter such as increased mechanical stability and therefore increased lifetime, the X-ray source may reveal superior properties with respect to reliability and lifetime. Apart from the inventive electron emitter, the X-ray source may comprise an anode to establish an electrical field between the electron emitter serving as a cathode and a target for generating the X-ray beam. Furthermore, electron optics may be provided.

It has to be noted that embodiments of the invention are described with reference to different subject matters. In particular, some embodiments are described with reference to the electron emitter whereas other embodiments are described with reference to the X-ray source or the method for preparing an electron emitter. However, a person skilled in the art will gather from the above and the following description that, unless other notified, in addition to any combination of features belonging to one type of subject matter also any combination between features relating to different subject matters is considered to be disclosed with this application.

The aspects defined above and further aspects, features and advantages of the present invention can be derived from the examples of embodiments to be described hereinafter and are explained with reference to the examples of embodiment. The invention will be described in more detail hereinafter with reference to examples of embodiment but to which the invention is not limited.

Figure 1A:
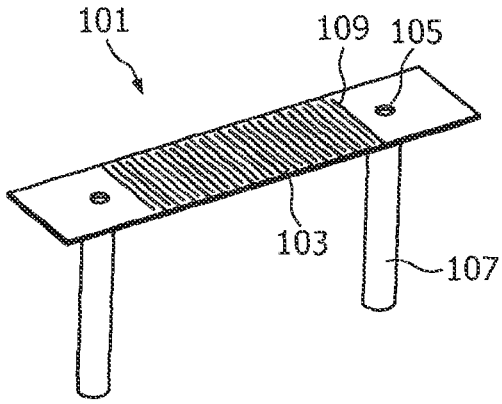
FIG. 1a (prior art)
FIGS. 1*a*, 1*b* show prior art thermionic electron emitters.
Figure 1B:
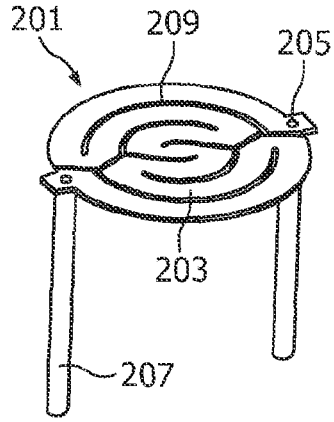
FIG. 1b (prior art)

The illustration in the drawings is schematically only.

DETAILED DESCRIPTION OF PREFERRED EMBODIMENTS

Figure 2:
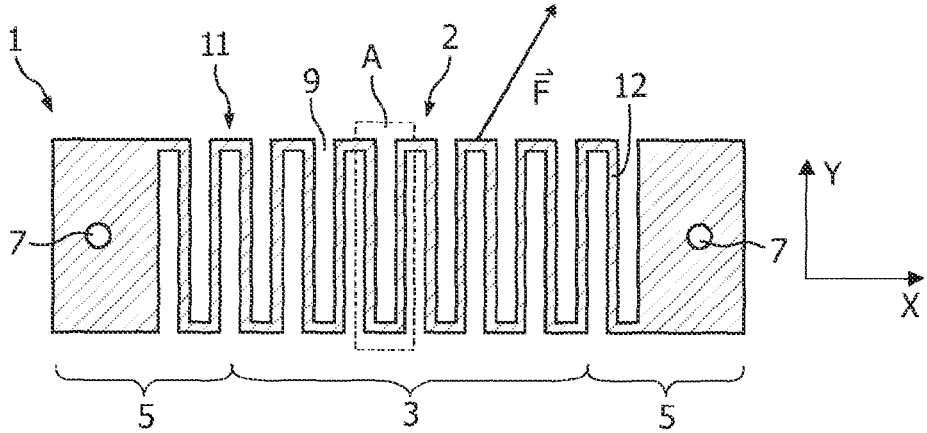
FIG. 2 shows a schematic top view of the electron emitter shown in FIG. 1*a*.

In FIG. 2, a top view onto an electron emitter 1 is shown. The macroscopic geometry of the electron emitter does not substantially differ from the one of a conventional electron emitter. An emitter part 2 comprises an emission surface 3 and bordering surfaces 5 adjacent to the emission surface 3. At connection points 7 terminals (not shown in FIG. 2) can be attached in order to apply an external electrical voltage to the emitter part 2. Thereby, a heating current can be induced in the electron emission surface 3 in order to heat it to a temperature for thermionic electron emission. In the emission surface 3 as well as in parts of the bordering surface 5, slits 9 can be provided in order to define a conduction path 11 in a meander form.

During normal operation of the electron emitter 1 for example in an X-ray tube of a CT gantry, external forces F can be applied to the electron emitter 1.

Figure 3A:
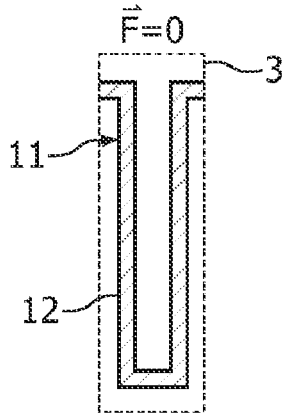
FIGS. 3*a*, 3*b* show an enlarged view of the section A indicated in FIG. 2 with and without application of an external force F.
Figure 3B:
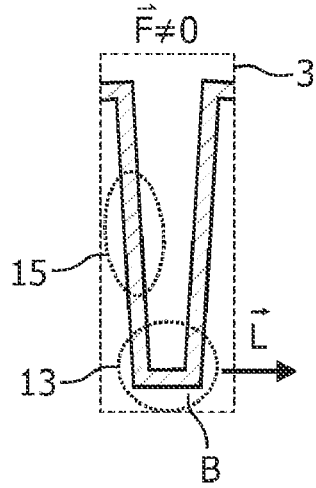

FIG. 3 shows an enlarged view of the portion A indicated in FIG. 2 of the meander-like conduction path 11. In FIG. 3*a*, the case is shown where no external force is applied (F=0). In FIG. 3*b*, the case where an external force is applied (F>0) is shown. The meander-like conduction path comprises a local region of high curvature 13 and, adjacent thereto, a region of lower or no curvature 15. As can be derived from FIG. 3*b*, the external force F results in main stress loads L in the region 13 of higher curvature wherein the stress loads are substantially oriented along the longitudinal direction of the meander form in this local region.

Figure 4A:
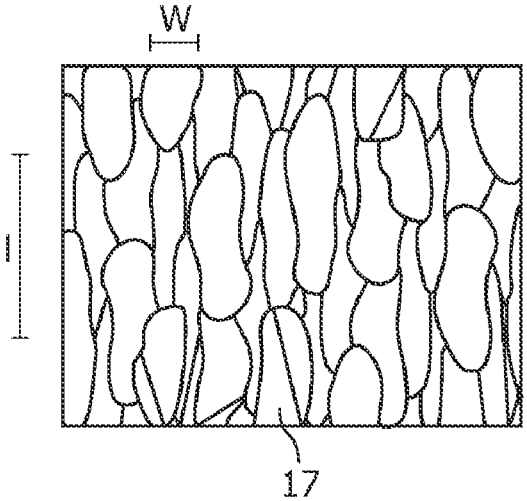
FIG. 4*a* shows a crystal grain structure with elongated interlocked grains of an anisotropic polycrystalline material.
Figure 4B:
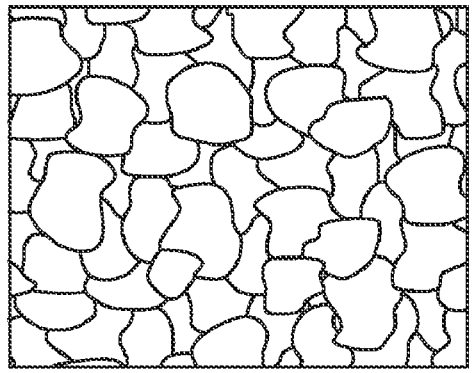
FIG. 4*b* shows a crystal structure of an isotropic polycrystalline material.

In FIG. 4*a*, an anisotropic crystal grain structure with elongated interlocked grains 17 is shown. The average dimension 1 of the grains in the longitudinal direction is substantially larger than its width w in a transversal direction. For comparing purposes, an isotropic polycrystal structure is shown in FIG. 4*b* wherein the crystal grains do not have any privileged direction of extension.

Figure 5:
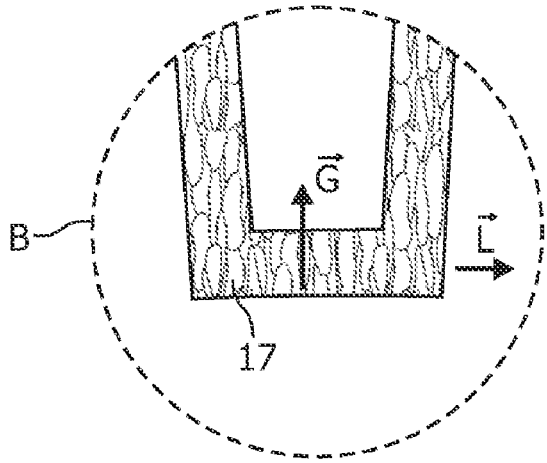
FIG. 5 shows an enlarged view of the portion B shown in FIG. 3*b* of an electron emitter according to an embodiment of the present invention.

FIG. 5 shows an enlarged view of a thermionic electron emitter in the region 13 where main stress loads L occur. It can be seen that the longitudinal direction G of the elongated grains 17 is substantially perpendicular to the direction of the main stress loads L.

Figure 6:
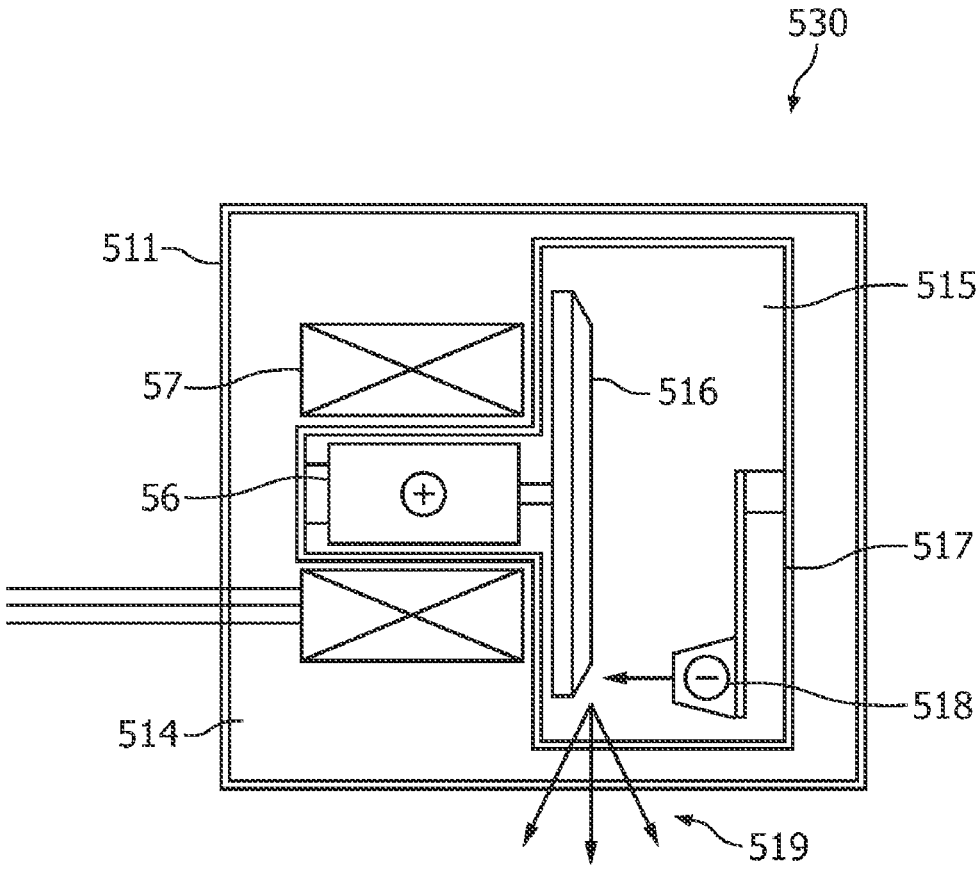
FIG. 6 schematically shows an X-ray tube according to an embodiment of the present invention.

FIG. 6 shows an X-ray tube 530 with a rotary anode 516 driven by an asynchronous machine via a rotatable shaft 56. The X-ray tube 530 consists of a cathode 518 and a rotary anode 516 within the vacuum 515 of an envelope 517. Electrons are accelerated from the cathode 518 to the rotary anode 516 and collide with the rotary anode 516 as the metal target. By colliding with the metal target X-ray photons 519 are emitted from the rotary anode 516. The envelope 517 is enclosed in a housing 511, which is filled with liquid 514 cooling the X-ray tube 530 and which comprises the stator 57 of the asynchronous machine.

In a non-limiting attempt to recapitulate the above-described embodiments of the present invention one could state: In order to produce an electron emitter that is functional under temperatures around 2400° C. and rotational loads or accelerations above 30 g, it is proposed to use a metal sheet with a long interlocked grain structure. During a cutting process of the metal sheet the grain structure of the sheet should be oriented as depicted in FIG. 5. The reason for this can be as follows: Depending on the direction of the axis of rotation during actual operation of the electron emitter, the reaction force F that is exerted onto the emitter can be directed in either Y- or X-direction. However, the maximum tensile stress in the high temperature area of the emitter is usually directed along the X-axis irrespective of the direction of the rotation axis. If the structure of the metal sheet is oriented as shown in FIG. 5, namely with the longitudinal axis of the grain structure substantially perpendicular to the direction of tensile stress, substantial plastic deformation caused by intergranual slip which might eventually cause a short circuit can be prevented. This will substantially decrease the high temperature creep of the material of the electron emitter and increase the emitter's lifetime. It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

The invention claimed is:

1. A thermionic electron emitter (1) comprising:

an emitter part (2) comprising a substantially flat electron emission surface (3) and a bordering surface (5) adjacent to the electron emission surface;

a heating arrangement for heating the emission surface to a temperature for thermionic electron emission;

wherein the emitter part comprises an anisotropic polycrystalline material with a crystal structure of elongated interlocked grains (17) having a dimension in a longitudinal direction (G) larger than in a transversal direction;

wherein the longitudinal direction is oriented substantially perpendicular to a direction (L), in which main stress loads occur during normal operation of the emitter.

2. The thermionic electron emitter according to claim 1, wherein in both regions, the electron emission surface as well as the bordering surface, the longitudinal direction of the grains is oriented substantially perpendicular to a direction, in which main stress loads occur during normal operation of the emitter.

3. The thermionic electron emitter according to claim 1, wherein slits (9) are provided in the electron emission surface (3) in order to define conduction paths (11) in a meander form wherein the meander form comprises local regions (13) of high curvature with local regions (15) of lower curvature adjacent thereto and wherein the longitudinal direction of the grains is oriented perpendicular to a longitudinal direction of the meander form in the local regions of higher curvature.

4. The thermionic electron emitter according to claim 1, wherein the emitter part has a rectangular outline and linear slits in order to define conduction paths in a meander form and wherein the longitudinal direction of the grains is oriented parallel to a longitudinal direction of the slits.

5. The thermionic electron emitter according to claim 1, wherein the emitter part is provided with a crystallized metal sheet having a uniform crystal grain structure of elongated interlocked grains.

6. The thermionic electron emitter according to claim 1, wherein the dimensions of the crystal grains is such as after substantial saturation of crystal growth.

7. A method of preparing an electron emitter for thermionic electron emission, comprising:

determining a design of the electron emitter;

determining a direction of main stress loads occurring during normal operation of the electron emitter;

preparing the electron emitter with an anisotropic polycrystalline material with a crystal structure of elongated interlocked grains having a dimension in a longitudinal direction larger than in a transversal direction;

wherein the longitudinal direction of the grains is oriented substantially perpendicular to the direction of the main stress loads.

8. The method according the claim 7, comprising:

providing a sheet of anisotropic polycrystalline material with a crystal structure of elongated interlocked grains, the sheet having a rectangular outline;

preparing linear slits into the sheet such that the orientation of the slits is substantially parallel to the longitudinal direction of the elongated grains.

9. X-ray source including a thermionic electron emitter according to claim 1.

* * * * *